US006119370A

United States Patent [19]

Baron

[11] Patent Number: 6,119,370

[45] Date of Patent: Sep. 19, 2000

[54] SOLE LINER FOR SHOE

[76] Inventor: Kyle L. Baron, 5260 S. Maryknoll Dr., New Berlin, Wis. 53151

[21] Appl. No.: 09/248,456

[22] Filed: Feb. 11, 1999

[51] Int. Cl.[7] ..... A43B 13/20

[52] U.S. Cl. ..... 36/29; 36/30 R; 36/44; 36/141

[58] Field of Search ..... 36/25 R, 28, 29, 36/30 R, 44, 141

[56] References Cited

U.S. PATENT DOCUMENTS

| | | |
|---|---|---|
| 3,834,046 | 9/1974 | Fowler . |
| 4,183,155 | 1/1980 | Payne . |
| 4,499,672 | 2/1985 | Kim . |
| 4,635,384 | 1/1987 | Huh et al. . |
| 5,152,081 | 10/1992 | Hallenbeck et al. . |
| 5,189,816 | 3/1993 | Shibata . |
| 5,595,003 | 1/1997 | Snow . |
| 5,619,809 | 4/1997 | Sessa . |
| 5,915,819 | 6/1999 | Gooding . |

OTHER PUBLICATIONS

1.) Ad for Gel Filled Insoles 2.) Ad for ArchMates by FootSmart Products 3.) Boston Store ad for Gel–Soles 4.) Fetherspring Brochure 5.) Article from Discover Magazine entitled "The Purpose of Toes" dated Feb. 1995.

*Primary Examiner*—Ted Kavanaugh
*Attorney, Agent, or Firm*—Ryan Kromholz & Manion, S.C.

[57] ABSTRACT

An insert or inner sole for a shoe having as its purpose support of the metatarsal and arch portions of the foot to thereby reduce pressure on those areas and associated foot pain. The insert or inner sole has three layers that interface with one another to create and displace a metatarsal hump. As a foot strides, the flex plate layer rocks forward and back on its centrally located, relatively thicker hump portion. The flex plate may engage the bottom layer by way of serration or friction.

9 Claims, 4 Drawing Sheets

SOLE LINER FOR SHOE

BACKGROUND OF THE INVENTION

This invention relates to shoe liners, particularly to a liner designed to provide support to the metatarsal and arch portions of the foot.

Problems pertaining to the foot are particularly troublesome due to the impact foot problems have on the rest of the body. A problem starting in the foot can affect posture, spinal alignment, joints and balance. Even a small change in footing can create dramatic changes in other areas of the body. Further, each foot has more than 25 bones held in place by tendons, muscles, and ligaments, each one capable of producing pain.

Solutions to alleviate common foot pain are many and varied. One such solution lies in the vast array of shoe inserts and shoe liners marketed today. Shoe inserts and sole liners are widespread and their configurations vary greatly. Frequently, such devices utilize a cushioning gel or other flexible substance to support or cradle the foot. Further, various protuberances are often incorporated with therapeutic massaging purpose. While these solutions have their place, none has been able to effectively combine support with massage. An embodiment of the present invention integrates support and massage characteristics as an integral unit.

SUMMARY OF THE INVENTION

It is one of the features of the present invention to provide an insole for disposal in a shoe adjacent the sole of the foot which includes a flex plate designed to both create and displace a metatarsal hump and decrease the effects of force on sensitive areas of the foot during striding. The flex plate rocks forward and back with each stride, thus creating a temporary metatarsal hump for support of the metatarsal and arch portions of the foot.

In the preferred embodiment of the present invention, the sole liner is composed of a typical exposed layer. This layer is made of material such as soft vinyl, typical of common liners, such as those marketed by Dr. Scholls and manufactured by Schering-Plough Health Care Products. Immediately beneath this exposed layer is a flex plate layer composed of a material which is relatively more rigid than the exposed layer. The flex plate is not of uniform thickness; rather, the central portion, located intermediate the shoe ends, is of a greater thickness than the ends. In addition, the central portion of the bottom surface of the flex plate and the upper surface of the underlying bottom plate preferably includes mating opposed interrupted surfaces. The underlying bottom plate layer is located immediately adjacent the shoe bed. In a preferred embodiment, the bottom plate engages the flex plate by way of a toothed surface located directly beneath the thicker, intermediate portion of the flex plate which in turn embodies a correspondingly toothed surface. Smooth sliding between the flex plate and bottom plate is facilitated through the use of a lubricant, such as a film of gel dispersed on the top surface of the bottom plate and bottom surface of the flex plate. A shoe liner known as GEL-SOLES™ contains a lubricant having qualities characteristic of this invention. GEL-SOLES™ are marketed by PPM, located at 129 McCarrell Lane, Zelienople, Pa. PPM also markets a similar product known as BODY SHOCKS™. The exposed layer and the bottom plate are sealed to one another along their peripheral margins. The flex plate may be secured to the other two members, typically at the heel end.

In a second embodiment, it is contemplated that the flex plate provides, at its thicker intermediate portion, frictional rather than toothed engagement with the bottom plate.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
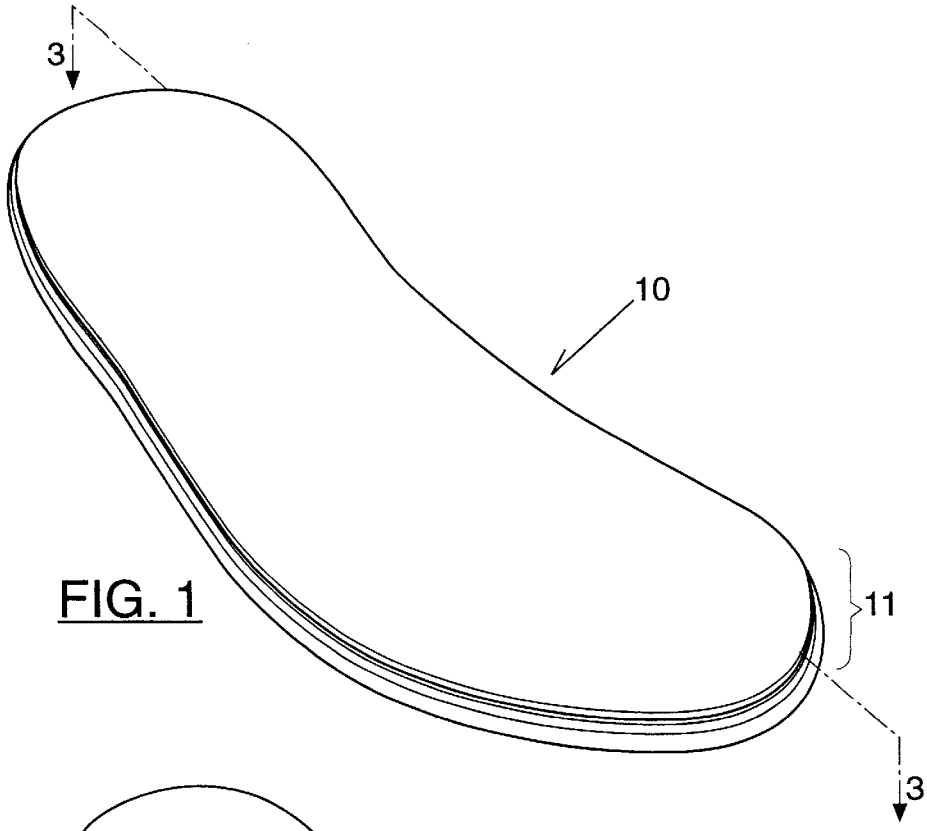
FIG. 1 is a perspective view of the sole liner as seen prior to insertion in a conventional shoe.
Figure 2:
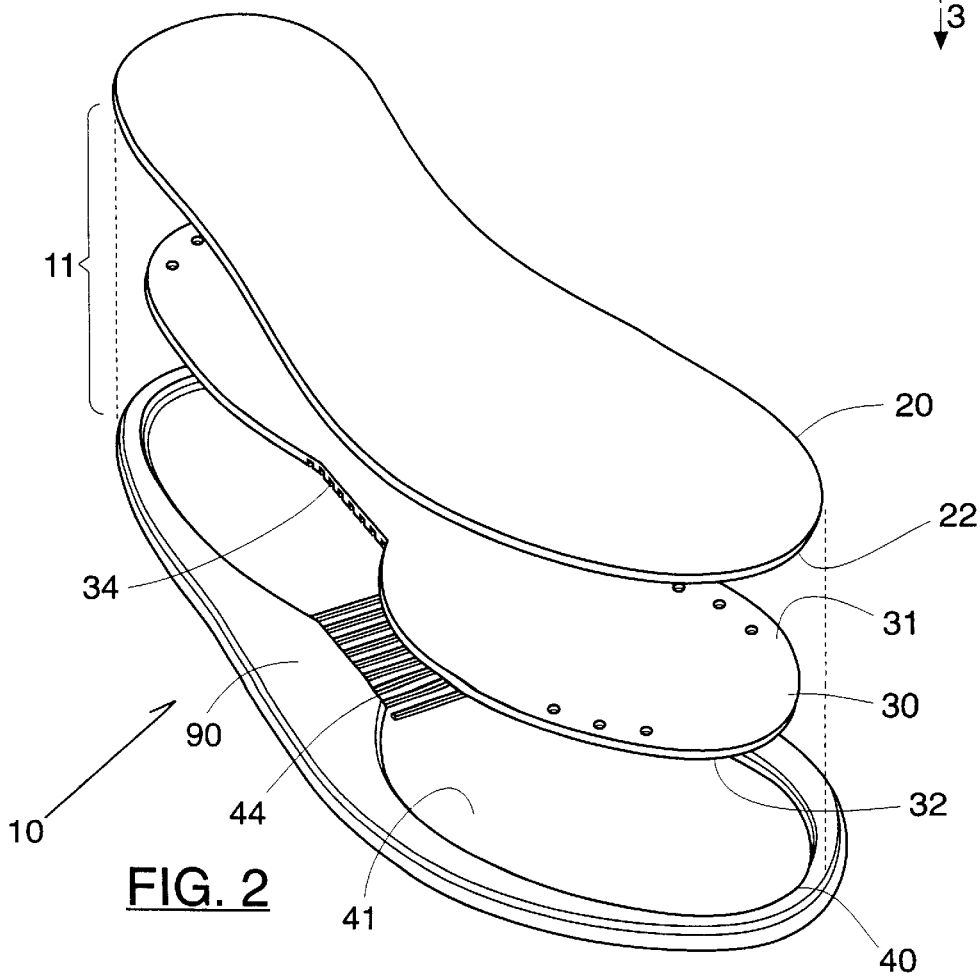
FIG. 2 is an exploded view illustrating the various layers of an embodiment of the sole liner of this invention.

With reference to the views of FIGS. 1 and 2, a preferred embodiment of the invention includes the sole liner 10 with its various layers 11 as seen prior to insertion into a conventional shoe. Although shown as an integral structure for insertion into a shoe, it will be understood, and will be explained later, that it can be permanently disposed in the shoe during manufacture of the shoe. The exploded view of FIG. 2 particularly details the relationship of the various layers generally designated by the reference numeral 11. Preferably, the sole liner 10 has a shape and size equivalent to the shoe into which it is inserted, although it is to be understood that it could be of any other suitable shape.

Figure 10:
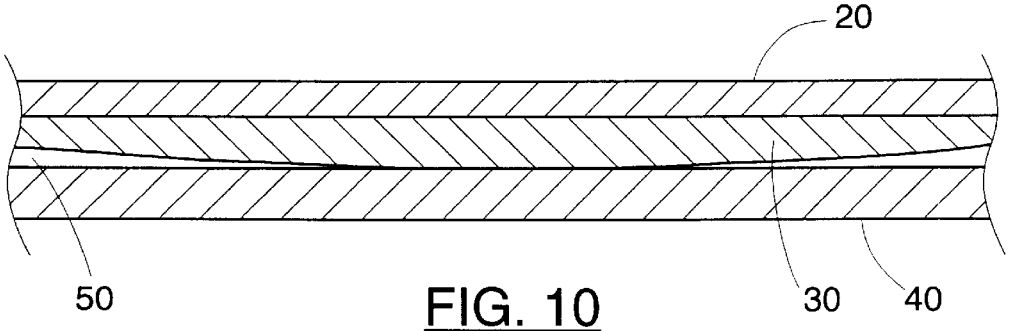
FIG. 10 is an enlarged partial cross sectional view, similar to the views of FIGS. 7, 8, and 9, of the intermediate portion of another embodiment of the sole liner showing frictional engagement of the layers with teeth eliminated.

As illustrated in FIG. 2, the sole liner 10, in its preferred embodiment, contains three layers. Each layer member 11 has a shape and size equivalent to the shoe bed 52 (see FIGS. 6A and 6B) into which the sole liner 10 is to be inserted, although there may be variations in shape in instances where this configuration is not feasible. The exposed layer, 20 is directly contacted by a foot (not shown). The exposed layer, 20 is made of a material such as flexible plastic or vinyl designed to move with the motion of a foot in typical gait. A flex plate 30, is located directly beneath the exposed layer 20 and is formed of a material relatively more rigid than the exposed layer 20. Further, the flex plate 30 has a top surface, 31 in direct contact with the underside 22 of exposed layer 20. The bottom surface 32, of flex plate 30 rests on the top surface 41 of bottom plate 40. In the preferred embodiment, the bottom surface 32 of flex plate 30 includes an intermediate portion 33 provided with a serrate surface 34 which engages the similarly serrate surface 44 of bottom plate 40. In an alternate embodiment, bottom surface 32 of flex plate 30 frictionally engages top surface 41 of bottom plate 40 without a serrate surface. (See FIG. 10) Any conventional adhesive may be applied to the peripheral margins 90 of exposed layer 20 and bottom plate 40 to provide means to secure the two layer members to each other. The flex plate 30 is freely suspended between exposed layer 20 and bottom plate 40. Flex plate 30 may be attached to bottom plate 40 at the heel portion 80 by way of adhesive similar to that used on the peripheral margins 90 or by other suitable connecting means.

Figure 3:
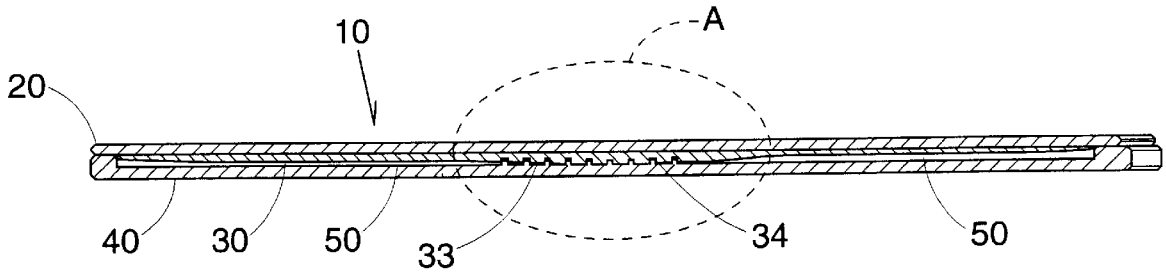
FIG. 3 is cross sectional view, taken along lines 3—3 of FIG. 1, and showing the sole liner in resting position with neither heel nor toe of a foot exerting force thereon.

While the flex plate bottom surface 32 rests on the bottom plate top surface 41, it should be noted that the two surfaces, 32 and 41 are not in constant contact. Referring to FIG. 3, a small cavity 50 is formed between surfaces 32 and 41 when the sole liner rests in a neutral position with no force exerted on exposed layer 20. The cavity 50 is in constant flux during striding. (As illustrated in FIGS. 4 and 5).

Figure 4:
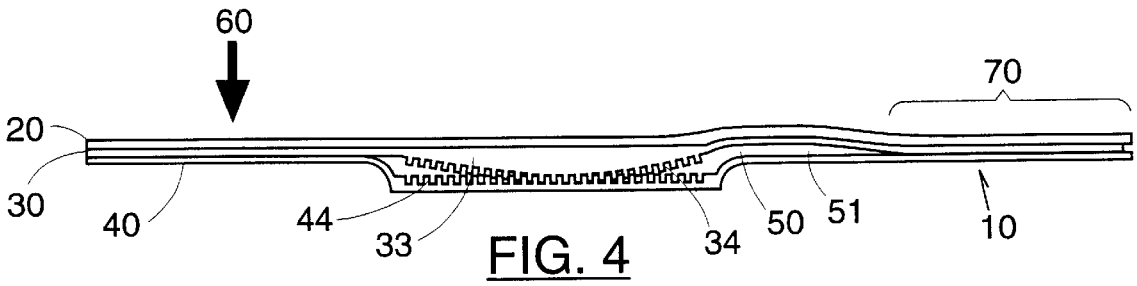
FIG. 4 is a cross sectional view similar to the view of FIG. 3 and taken approximately along lines 3—3 of FIG. 1, and showing the sole liner with force exerted by the heel of a foot (not shown.

Referring to FIG. 4, when the heel of a foot (not shown) exerts force, 60 on the heel portion 80 of sole liner 10, the cavity 50 is displaced toward the toe end 70 of the sole liner 10. As seen in FIG. 5, when a foot (not shown) exerts force, 60 on the toe region 70 of the sole liner 10, the cavity 50 is displaced toward the heel end 80 of the sole liner 10. The cavity 50 provides temporary support and massage as it is displaced from toe end 70 to heel end 80 of the sole liner 10. A lubricant 51, such as a known gel composition, is dispersed in the cavity 50 to facilitate the sliding of flex plate 30 and subsequent displacement of cavity 50.

Figure 5:
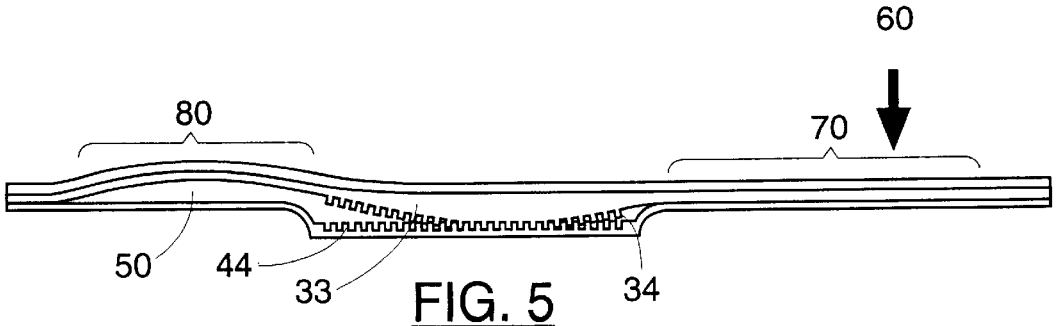
FIG. 5 is a cross sectional view similar to the view of FIG. 3 and taken approximately along lines 3—3 of FIG. 1, and showing the sole liner with force exerted by the toe portion of a foot (not shown)

One of the features of flex plate 30 is an intermediate portion of relatively distended thickness 33, seen exaggerated in FIGS. 4 and 5. While FIGS. 4 and 5 depict distended portion 33 in a position approximately equidistant the ends of sole liner 10, it is to be understood that it may occupy any region of the flex plate 30. Referring to FIG. 3, distended portion 33 is depicted in a force neutral position. The relationship of the distended portion 33 of flex plate 30 on exposed layer 20 and bottom plate 40 is best viewed in FIGS. 7–10 which show an enlarged view of this area, referenced by the reference character A in FIG. 3.

Figure 7:
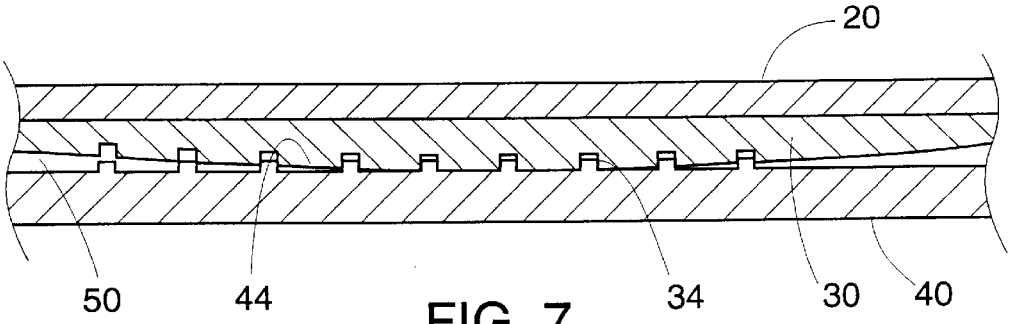
FIG. 7 is an enlarged partial cross sectional view of the intermediate area, identified by the reference character "A", in the view of FIG. 3, of the sole liner showing a square toothed embodiment.
Figure 8:
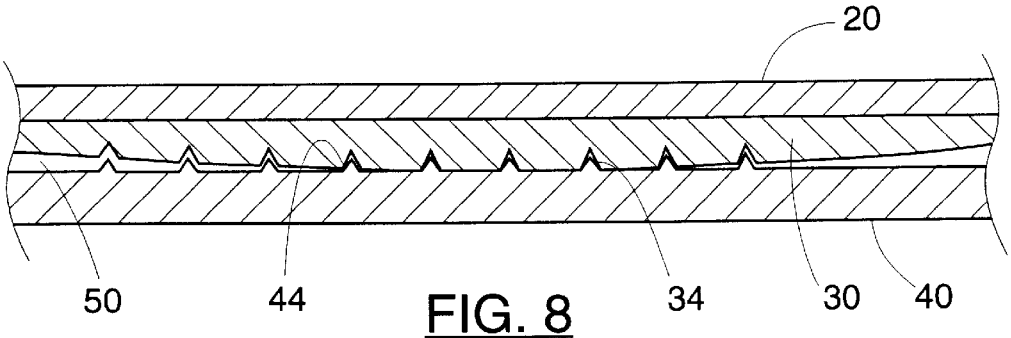
FIG. 8 is an enlarged partial cross sectional view similar to the view of FIG. 7, and indicating another embodiment in which the intermediate area has pointed teeth.
Figure 9:
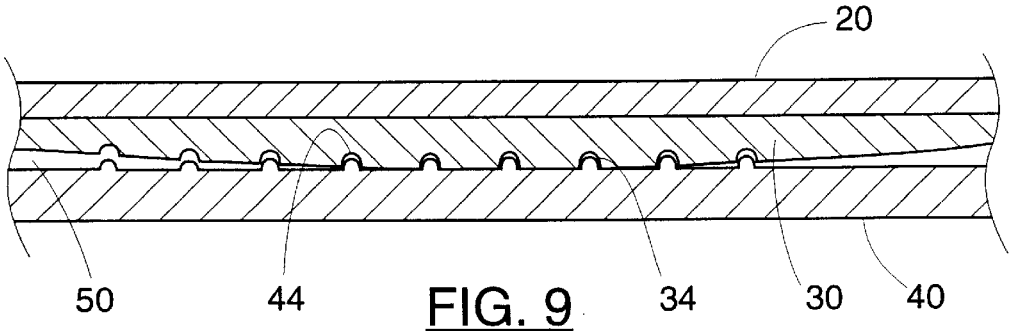
FIG. 9 is an enlarged partial cross sectional view similar to the views of FIGS. 7 and 8, of yet another embodiment of the sole liner showing an intermediate portion having curved teeth.

The alternate embodiments of serrate surfaces 34 and 44 depicted in FIGS. 7, 8, and 9 represent variations in serration shape which may be utilized. It is to be understood that any other shape may be used to provide the same effect. Another embodiment of the sole liner envisions surfaces 32 and 41 in frictional engagement and no serrations (see FIG. 10).

Figure 6A:
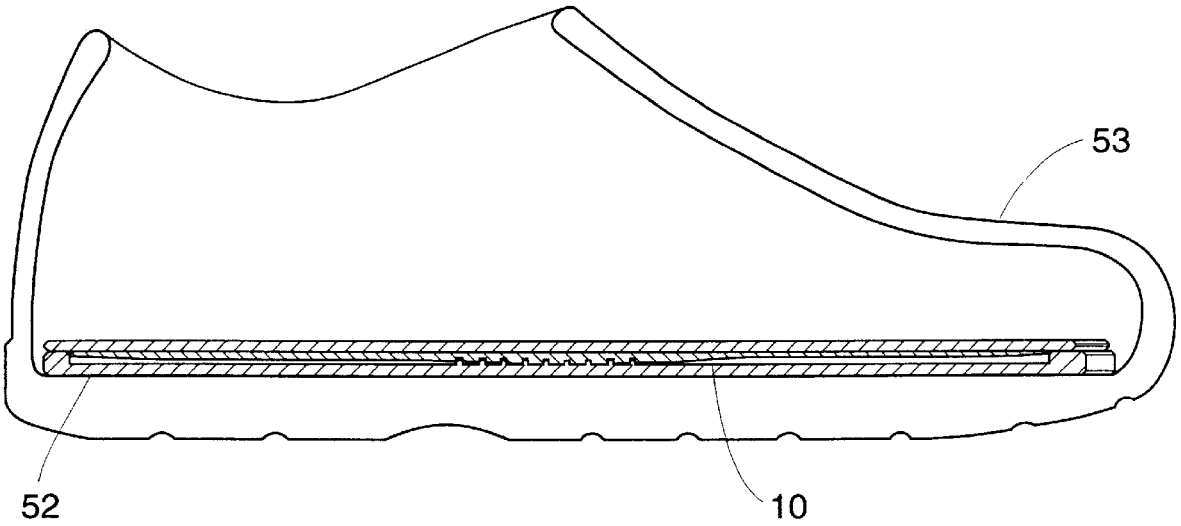
FIG. 6A is a cross sectional view of the sole liner as dispersed within a shoe.
Figure 6B:
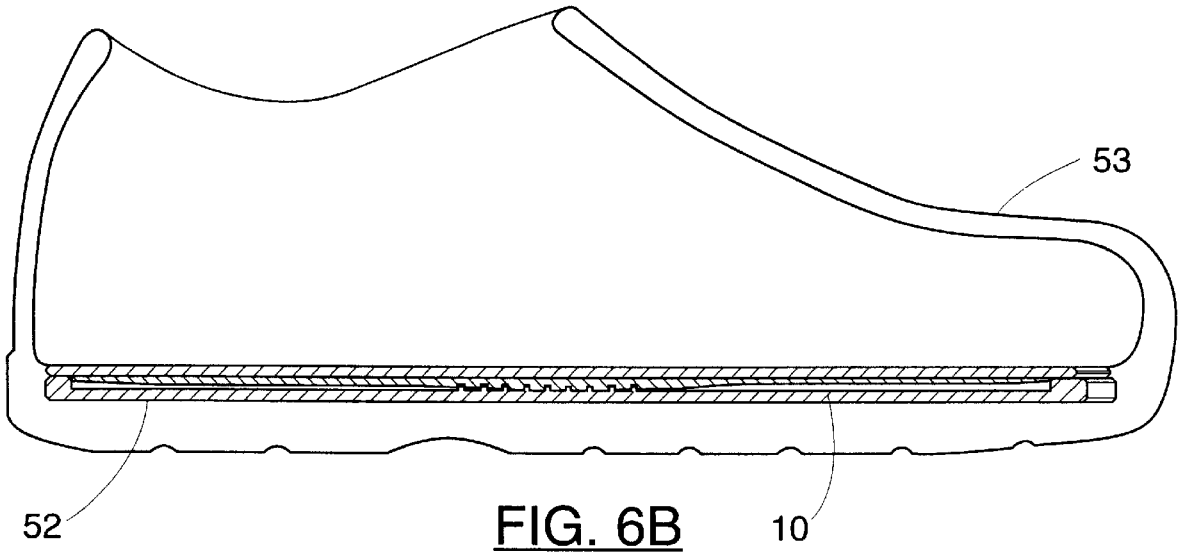
FIG. 6B is a cross sectional view of the sole liner as dispersed within a shoe and integrally formed therewith.

The present invention allows for both independent placement in a shoe and placement during shoe manufacture. Referring to FIG. 6A, the invention rests on a shoe bed, 52 and is depicted as an after-market insert. FIG. 6B is a view of the sole liner 10 on a shoe bed 52 after having been manufactured as an integral part of a shoe 53. It is anticipated that the present invention may be used in either of these settings.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A sole liner for footwear comprised of an exposed layer, a flex plate layer, and a bottom plate layer, said exposed layer, flex plate layer, and bottom plate layer having a configuration substantially conforming to the size and shape of at least a portion of the footwear into which said sole liner is to be inserted, wherein a bottom surface portion of said flex plate layer has a serrate surface and a top surface portion of said bottom plate has a serrate surface, and wherein individual serrations of said serrate bottom surface portion are engageable with individual serrations of said serrate top surface portion, and wherein said bottom surface portion defines a section of distended thickness in cross section, and wherein said section of distended thickness tapers in opposed longitudinal directions to define relatively constricted ends of said flex layer.

2. The sole liner of claim 1, wherein said serrations are disposed for relative mating engagement.

3. The sole liner of claim 1, wherein said individual serrations are of triangular configuration.

4. The sole liner of claim 1, wherein said individual serrations are of semicircular configuration.

5. The sole liner of claim 1, wherein said individual serrations are of rectangular configuration.

6. The sole liner of claim 1 wherein at least two of said layers are secured to one another.

7. The sole liner of claim 1, wherein said exposed layer and said bottom layer are secured to one another along their peripheral margins.

8. The sole liner of claim 1, wherein a lubricant is disposed between said flex plate layer and said bottom plate layer.

9. A sole liner for footwear comprising of an exposed layer, a flex plate layer, and a bottom plate layer, said exposed layer, flex plate layer, and bottom plate layer having a configuration substantially conforming to the size and shape of at least a portion of the footwear into which said sole liner is to be inserted, wherein a bottom surface portion of said flex plate layer has a serrate surface and a top surface portion of said bottom plate has a serrate surface, and wherein a plurality of said serrations of said serrate bottom surface portion are engageable with a plurality of said serrations of said serrate top surface portion, and wherein said bottom surface portion defines a section of distended thickness, and wherein said section of distended thickness tapers in opposed longitudinal directions to define relatively constricted ends of said flex layer.

* * * * *